US010446991B2

(12) United States Patent
Chien et al.

(10) Patent No.: US 10,446,991 B2
(45) Date of Patent: Oct. 15, 2019

(54) PLUG STRUCTURE AND POWER DEVICE

(71) Applicant: Lite-On Technology Corporation, Taipei (TW)

(72) Inventors: Hao Chien, Taipei (TW); Yi-Hung Lin, Taipei (TW); Shuo-Jen Shieh, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/884,388

(22) Filed: Jan. 31, 2018

(65) Prior Publication Data

US 2019/0027877 A1 Jan. 24, 2019

(30) Foreign Application Priority Data

Jul. 19, 2017 (CN) ..... 2017 1 0591990

(51) Int. Cl.

| | |
|---|---|
| ***H01R 27/00*** | (2006.01) |
| ***H01R 13/436*** | (2006.01) |
| ***H01R 31/06*** | (2006.01) |
| *H01R 13/625* | (2006.01) |
| *H01R 24/68* | (2011.01) |

(52) U.S. Cl.

CPC ..... *H01R 27/00* (2013.01); *H01R 13/436* (2013.01); *H01R 31/06* (2013.01); *H01R 13/625* (2013.01); *H01R 24/68* (2013.01)

(58) Field of Classification Search

CPC ..... H01R 27/00; H01R 13/436

See application file for complete search history.

(56) References Cited

U.S. PATENT DOCUMENTS

| | | | | |
|---|---|---|---|---|
| 4,543,624 | A * | 9/1985 | Rumble | H01R 13/6675 363/146 |
| 5,474,464 | A * | 12/1995 | Drewnicki | H01R 27/00 439/143 |
| 5,684,689 | A * | 11/1997 | Hahn | H01R 13/6675 363/146 |
| 6,227,888 | B1 * | 5/2001 | Hahn | H01R 27/00 439/172 |
| 7,896,702 | B2 * | 3/2011 | Stiehl | H01R 13/6658 439/620.22 |
| 8,382,526 | B2 * | 2/2013 | Chen | H01R 31/06 439/173 |
| 2010/0291786 | A1 * | 11/2010 | Hopwood | H01R 13/6273 439/345 |

(Continued)

FOREIGN PATENT DOCUMENTS

| | | |
|---|---|---|
| TW | 201114120 | 4/2011 |

OTHER PUBLICATIONS

"Office Action of Taiwan Counterpart Application", dated Apr. 13, 2018, p. 1-p. 6, in which the listed reference was cited.

*Primary Examiner* — Truc T Nguyen
(74) *Attorney, Agent, or Firm* — JCIPRNET

(57) ABSTRACT

A plug structure includes a pin base, a plurality of conductive elastic pieces and a pin set. The conductive elastic pieces are separately assembled on the pin base, and each of the conductive elastic pieces has a sharing area. The pin set is replaceably assembled on the pin base and has a plurality of pins. The pins are respectively disposed corresponding to the conductive elastic pieces and electrically coupled to the sharing area of each of the conductive elastic pieces.

19 Claims, 7 Drawing Sheets

(56) References Cited

U.S. PATENT DOCUMENTS

| | | | | |
|---|---|---|---|---|
| 2011/0086527 | A1* | 4/2011 | Ruffner | H01R 27/00<br>439/105 |
| 2014/0199867 | A1* | 7/2014 | Rogers | H01R 27/00<br>439/173 |

* cited by examiner

PLUG STRUCTURE AND POWER DEVICE

CROSS-REFERENCE TO RELATED APPLICATION

This application claims the priority benefit of China application serial no. 201710591990.4, filed on Jul. 19, 2017. The entirety of the above-mentioned patent application is hereby incorporated by reference herein and made a part of this specification.

BACKGROUND

Field of the Invention

The invention relates to a plug structure and a power device. More particularly, the invention relates to a plug structure which is capable of being changed among different standards and is miniaturized and a power device using the plug structure.

Description of Related Art

A currently available power device is composed of a body and a plug structure, wherein an elastic hook is disposed on the body. The elastic hook is co-operated with a slot of the plug structure, thereby assembling a plug of the plug structure to the body. In order to operate the power device normally, a position of the plug structure relative to the body cannot be changed, and the plug structure cannot be replaced after the plug structure is assembled to the body.

SUMMARY

The invention provides a plug structure having a pin set replaceably assembled on a pin base, thereby reducing production cost.

The invention provides a power device, having the aforementioned plug structure, can achieve reducing production cost and increasing competitiveness.

A plug structure of the invention includes a pin base, a plurality of conductive elastic pieces and a pin set. The conductive elastic pieces are separately assembled on the pin base, wherein each of the conductive elastic pieces has a sharing area. The pin set is replaceably assembled on the pin base and includes a plurality of pins, wherein the pins are respectively disposed corresponding to the conductive elastic pieces and electrically coupled to the sharing areas.

In an embodiment of the invention, the pin base has a top surface, a peripheral surface surrounding the top surface, two accommodating slots and a partition. An end of each of the accommodating slots is connected to the peripheral surface, and the accommodating slots are disposed in a penetrating axis of the pin base. The partition is disposed on the top surface, protrudes from a side of each of the accommodating slots and protrudes from a part of the peripheral surface, and the partition divides the top surface into a plurality of symmetric areas.

In an embodiment of the invention, the pin base has a rotation angle, the partition has a plurality of blocking portions, and the rotation angle is between the penetrating axis one and each of the blocking portions of the partition.

In an embodiment of the invention, the conductive elastic piece are symmetrically disposed on the pin base. Each of the conductive elastic pieces includes a power holding portion, and a first horizontal straight-line distance from a side of each of the accommodating slots to the power holding portion nearby is at least 5.3 mm. A second horizontal straight-line distance from the power holding portion to an edge of the pin base is at least 6.5 mm.

In an embodiment of the invention, each of the conductive elastic pieces further includes a body portion, a fixing portion and a free portion bent relative to the body portion. The free portion is located on the body portion and has the sharing area, and each of the conductive elastic pieces is fixed on the pin base through the fixing portion.

In an embodiment of the invention, a first vertical height of a first side of each of the accommodating slots is greater than a second vertical height of a second side of each of the accommodating slots, and the second vertical height is at least 1.7 mm.

In an embodiment of the invention, the pin set includes a cover, the cover has at least one engagement slot, and the at least one engagement slot is engaged on the partition, thereby assembling the pin set on the pin base.

In an embodiment of the invention, the cover covers the pin base and the conductive elastic pieces and has a plurality of openings, and the pins respectively pass through the openings to contact the conductive elastic pieces.

In an embodiment of the invention, the pin set complies with one of plug standards required by the United States, the United Kingdom, the European Union (EU), Australia, Japan, China, Korea, India, Brazil, Argentina, and Republic of Namibia.

A power device of the invention includes a plug structure and a power supplier. The plug structure has a pin base, a plurality of conductive elastic pieces and a pin set. The conductive elastic pieces are separately assembled on the pin base, wherein each of the conductive elastic pieces has a sharing area. The pin set is replaceably assembled on the pin base and includes a plurality of pins, wherein the pins are respectively disposed corresponding to the conductive elastic pieces and electrically coupled to the sharing areas. The power supplier includes a plurality of power pins, wherein the plug structure is detachably assembled on the power supplier in a rotation manner, such that that the power pins respectively contact the conductive elastic piece to be powered on.

In an embodiment of the invention, the pin base includes two protrusion portions and two first position-limiting members, and the power supplier includes an upper case, a lower case and a second position-limiting member. The upper case is assembled on the lower case and has an assembly area, a circular assembly chute and a plurality of positioning slots. The positioning slots are disposed on the circular assembly chute. The power pins are assembled on the upper case and located together with the second position-limiting member within the assembly area. The protrusion portions of the pin base respectively slide from positions of the corresponding positioning slots into the circular assembly chute and are rotated by an angle, such that one of the first position-limiting members interferes and is locked with the second position-limiting member, hereby conducting the plug structure with the power supplier.

In an embodiment of the invention, the power supplier further comprises a release pressing portion disposed on the upper case, and the plug structure is detached from the power supplier by pressing the release pressing portion.

Based on the above, in the design of the plug structure of the invention, each of the conductive elastic pieces has the sharing area, the pin set is replaceably assembled on the pin base, the pins of the pin set are respectively disposed corresponding to the conductive elastic pieces and electrically coupled to the sharing area of each of the conductive elastic pieces. In this way, the pin sets complying with various standards can share the conductive elastic pieces, which can effectively reduce production cost.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
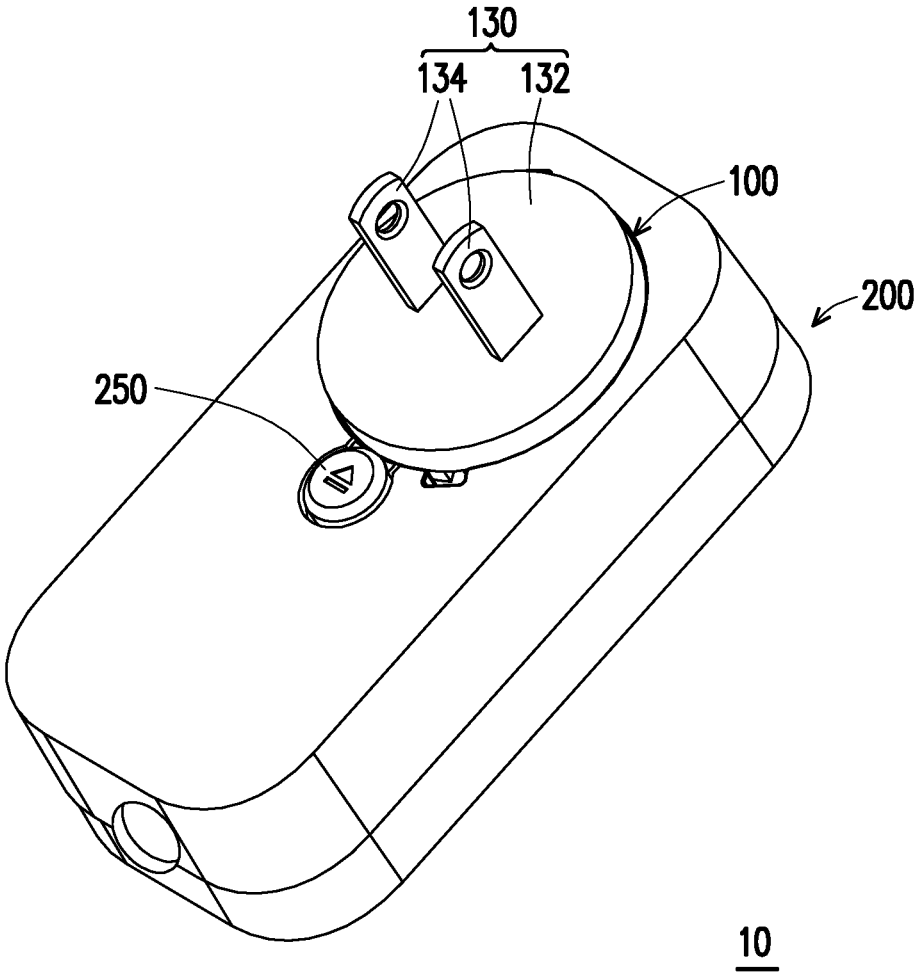
FIG. 1 is a schematic three-dimensional (3D) diagram illustrating a power device according to an embodiment of the invention.
Figure 2A:
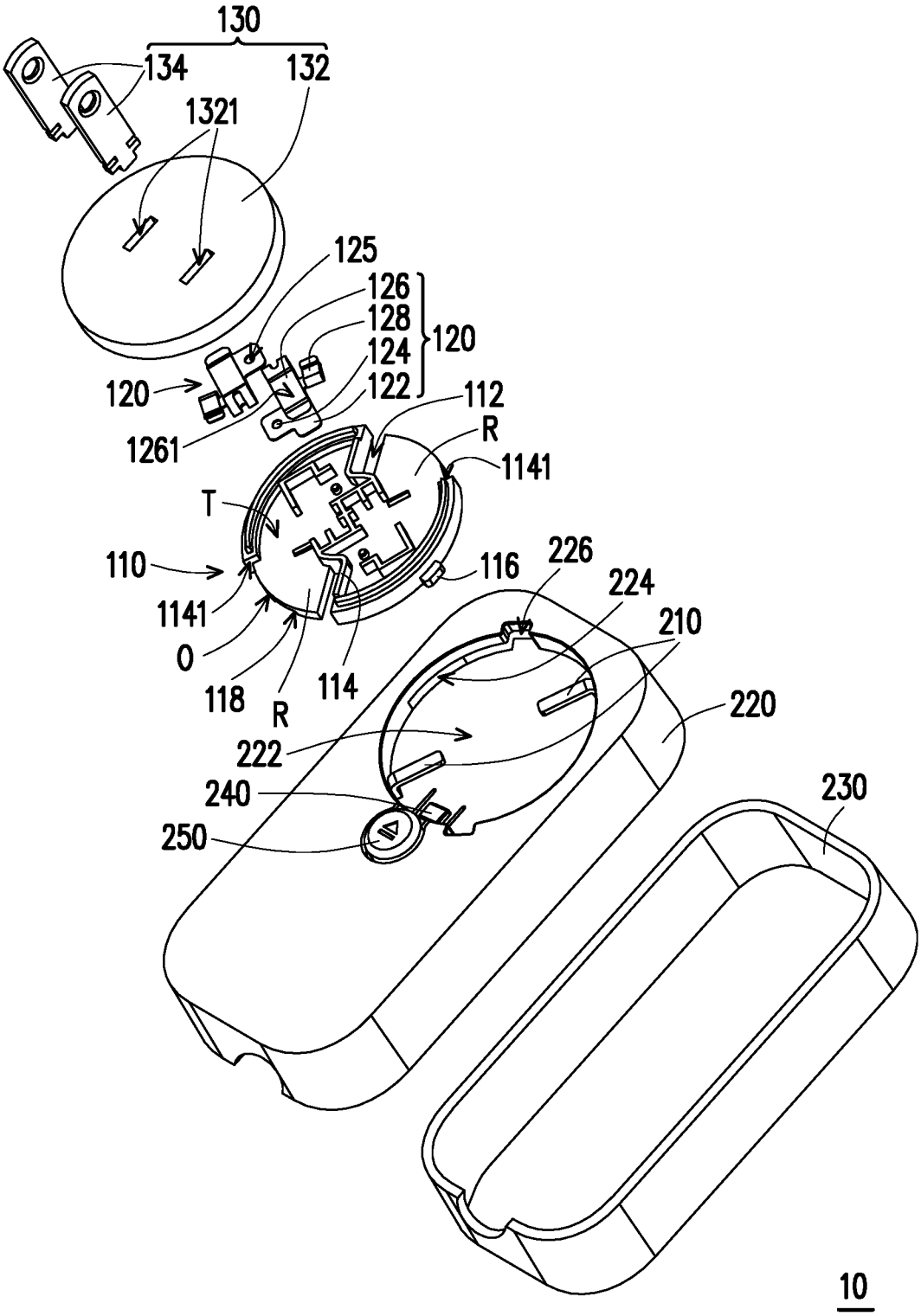
FIG. 2A is a schematic 3D exploded diagram illustrating the power device depicted in FIG. 1.
Figure 2B:
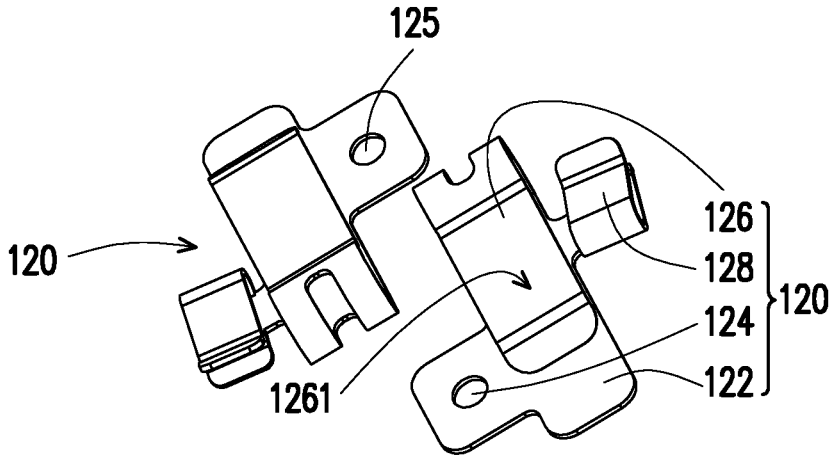
FIG. 2B is a schematic enlarged diagram illustrating a conductive elastic piece depicted in FIG. 2A.
Figure 3:
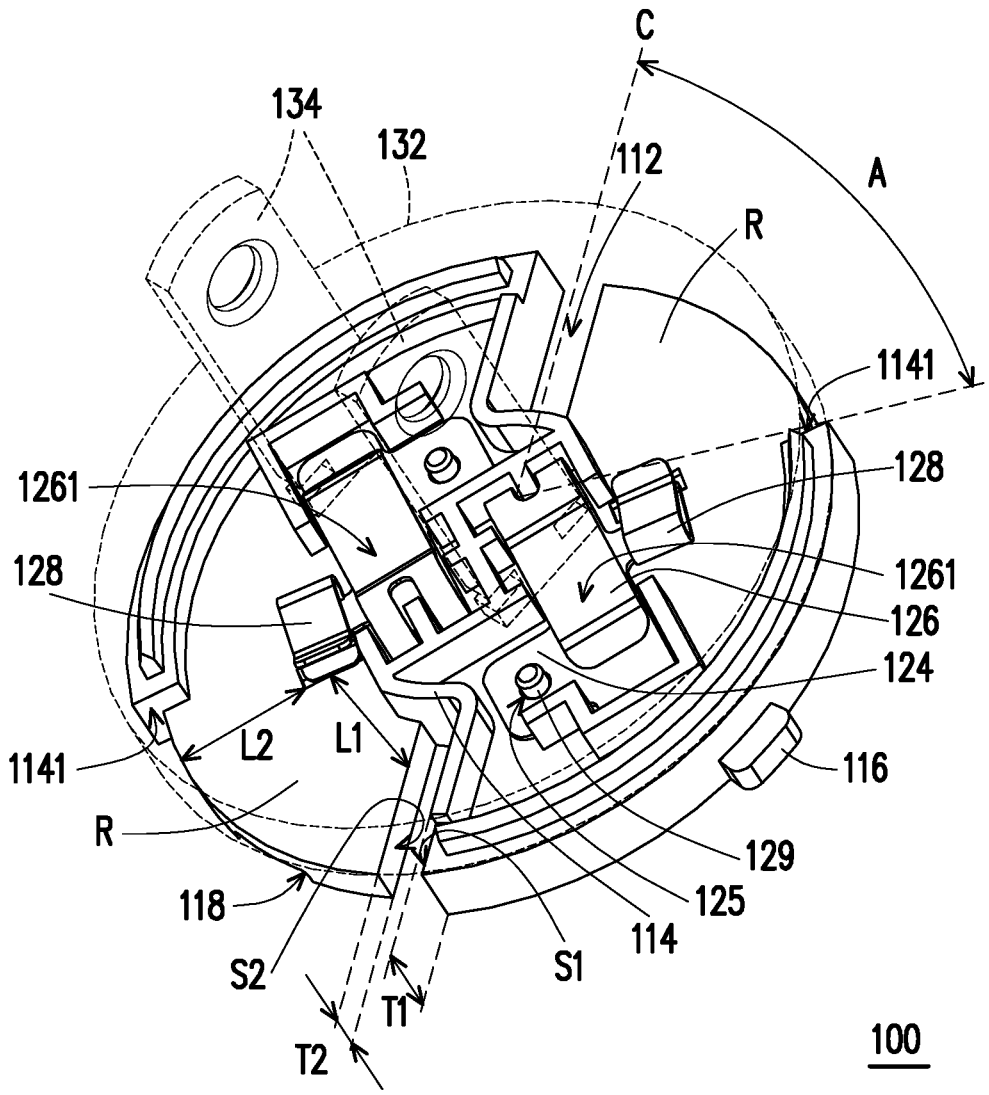
FIG. 3 is a schematic 3D diagram illustrating the plug structure depicted in FIG. 1.
Figure 4:
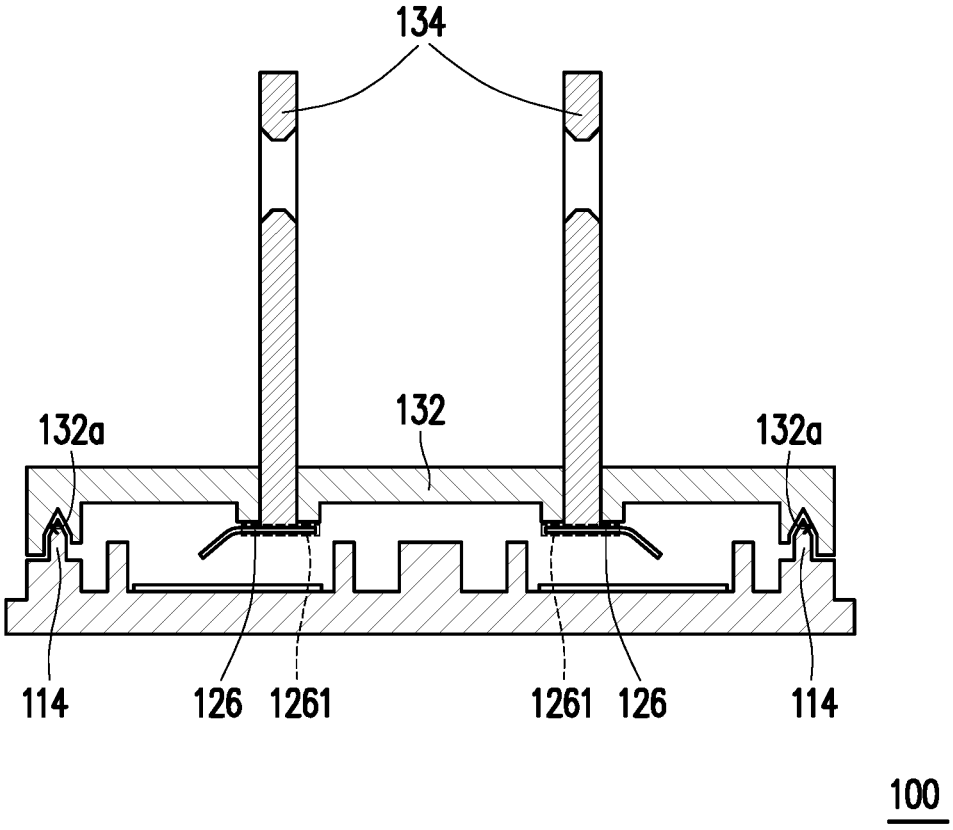
FIG. 4 is a schematic side cross-sectional diagram illustrating the plug structure depicted in FIG. 1.

FIG. 1 is a schematic three-dimensional (3D) diagram illustrating a power device according to an embodiment of the invention. FIG. 2A is a schematic 3D exploded diagram illustrating the power device depicted in FIG. 1. FIG. 2B is a schematic enlarged diagram illustrating a conductive elastic piece depicted in FIG. 2A. FIG. 3 is a schematic 3D diagram illustrating the plug structure depicted in FIG. 1. FIG. 4 is a schematic side cross-sectional diagram illustrating the plug structure depicted in FIG. 1. It has to be mentioned that for descriptive clearness, a pin set is illustrated by dotted-lines in FIG. 3. Referring first to FIG. 1 and FIG. 2A simultaneously, a power device 10 of the present embodiment includes a plug structure 100 and a power supplier 200. The plug structure 100 is detachably assembled on the power supplier 200 in a rotation manner, and the exchangeable plug structure of the present embodiment is adapted for a power device using AC power.

Referring to FIG. 2A, FIG. 2B, FIG. 3 and FIG. 4, the plug structure 100 includes a pin base 110, a plurality of conductive elastic pieces 120 and a pin set 130. The conductive elastic pieces 120 are separately assembled on the pin base 110, and each of the conductive elastic pieces 120 has a sharing area 1261. The pin set 130 is replaceably assembled on the pin base 110 and includes a plurality of pins 134. The pins 134 are respectively disposed corresponding to the elastic pieces 120 and electrically coupled to the sharing area 1261 of each of the conductive elastic pieces 120. In the present embodiment, the pins 134, for example, directly contact the sharing area 1261.

Specifically, referring to FIG. 2A and FIG. 3, the pin base 110 of the present embodiment has a top surface T, a peripheral surface O surrounding the top surface T, two accommodating slots 112 and a partition 114. The partition 114 is, for example, integrally formed. An end of each of the accommodating slots 112 is connected to the peripheral surface O, the accommodating slots 112 are disposed along a penetrating axis C of the pin base 110, and each of the accommodating slots 112 is connected to the peripheral surface O. The partition 114 is disposed on the top surface T, protrudes from a first side S1 of each of the accommodating slots 112 and protrudes from a part of the peripheral surface O. The part of the peripheral surface O which the partition 114 protrudes from has a plurality of blocking portions 1141. The partition 114 divides the top surface T of the pin base 110 into a plurality of symmetric areas R. In this case, the number of the symmetric areas R is, for example, two. Specifically, the partition 114 extends upward along peripheral edges of the accommodating slots 112 and protrudes therefrom. In addition, the pin base 110 has a rotation angle A, the rotation angle A is between the penetrating axis C and each of the blocking portions 1141 of the partition 114. In this case, the rotation angle A is not more than 60±10 degrees, which is not intent to limit the scope of the invention. Specifically, the rotation angle A is calculated from the penetrating axis C to the peripheral surface O where the partition 114 is disposed (i.e., the blocking portion 1141), and namely, no part of the partition 114 is disposed/protrudes within the range of the rotation angle A.

In addition, the pin base 110 further includes two protrusion portions 116 and two first position-limiting members 118, wherein the protrusion portions 116 are connected to the peripheral surface O and disposed symmetrically to each other, the two first position-limiting members 118 are respectively located on bottom surfaces of two symmetric areas R, and each first position-limiting member 118 is, for example, a recess, but the invention is not limited thereto. In other embodiments, the partition 114 may be divided into a plurality of parts, thereby correspondingly dividing the top surface T of the pin base 110 into the plurality of symmetric areas R.

Referring again to FIG. 2A and FIG. 3, the conductive elastic pieces 120 are symmetrically disposed on the top surface T of the pin base 110 and respectively located in the symmetric areas R. Each of the conductive elastic pieces 120 includes a body portion 122, a fixing portion 124, a free portion 126 bent relative to the body portion 122 and a power holding portion 128. The fixing portion 124 and the power holding portion 128 of each of the conductive elastic pieces 120 are respectively located on two sides of the body portion 122, and the free portion 126 is bendably connected to the body portion 122 and located on the body portion 122, wherein the free portion 126 has the sharing area 1261. The conductive elastic pieces 120 are fixed on the pin base 110 through the fixing portions 124, wherein the partition 114 of the pin base 110 is capable of effectively electrically isolating the conductive elastic pieces 120. In the present embodiment, as illustrated in FIG. 3, each fixing portion 124 has a through hole 125, and the conductive elastic pieces 120 passing through the through holes 125 of the fixing portions 124 are fixed on the top surface T of the pin base 110 through locking members 129 (e.g., screws or screw bolts).

In order to comply with the safety requirement, in the present embodiment, a first horizontal straight-line distance L1 from a second side S2 (i.e., a side which is not covered by the partition 114) of each of the accommodating slots 112 to the power holding portion 128 nearby is at least 5.3 mm, and a second horizontal straight-line distance L2 from the power holding portion 128 to the second side S2 (i.e., a side which is not covered by the partition 114) of the peripheral surface O is at least 6.5 mm. The aforementioned distances complying with the safety requirement are reserved in the horizontal direction in the plug structure 100 of the present embodiment to prevent an electric shock accident from occurring to a user when holding the plug structure 100. In addition, a first vertical height T1 of the first side S1 (i.e., the side which is covered by the partition 114) of each of the accommodating slots 112 is greater than a second vertical height T2 of the second side S2 (i.e., the side which is not covered by the partition 114) of each of the accommodating slots 112, wherein the second vertical height T2 is at least 1.7 mm.

Referring to FIG. 2A to FIG. 4, in the present embodiment, the pin set 130 is replaceably assembled on the pin base 110 and further includes a cover 132, wherein the cover 132 has at least one engagement slot 132*a*. In this case, the number of the at least one engagement slot 132*a* is two. The cover 132 covers the pin base 110 and the conductive elastic pieces 120 and has a plurality of openings 1321, wherein the pins 134 respectively pass through the openings 1321 to contact the sharing area 1261 of the corresponding conductive elastic piece 120. The engagement slots 132*a* of the cover 132 are symmetrically formed on a bottom surface of the cover 132 facing toward the pin base 110, wherein the engagement slots 132*a* are adapted to be engaged on the partition 114, thereby assembling the pin set 130 on the pin base 110.

To be more specific, the pin set 130 of the present embodiment can comply with one of plug standards required by the United States, the United Kingdom, the European Union (EU), Australia, Japan, China, Korea, India, Brazil, Argentina, and Republic of Namibia. In other words, all the pin sets 130 complying with the various plug standards may share the conductive elastic pieces 120 of the present embodiment, i.e., the pins 134 of the pin set 130 all are capable of directly contacting the sharing areas 1261 of the conductive elastic pieces 120 to share the same conductive elastic pieces 120. In this way, the production cost of the plug structure 100 may be effectively reduced.

In assembly, referring again to FIG. 2A, FIG. 3 and FIG. 4, the conductive elastic pieces 120 may be first disposed on the top surface T of the pin base 110 and respectively located in the symmetric areas R. In this circumstance, the conductive elastic pieces 120 are located at two sides of the partition 114 along the penetrating axis C, wherein the partition 114 may electrically isolate the conductive elastic pieces 120. Then, the pins 134 of the pin set 130 pass through the openings 1321 of the cover 132 to contact the sharing areas 1261 of the corresponding conductive elastic pieces 120. In this circumstance, the engagement slots 132*a* of the cover 132 are engaged on the partition 114, thereby assembling the pin set 130 on the pin base 110 and completing the assembly of the plug structure 100. Preferably, an overall thickness of the plug structure 100 is, not greater than 7.5 mm.

Referring to FIG. 1 and FIG. 2A, the power supplier 200 of the present embodiment includes a plurality of power pins 210, wherein the plug structure 100 is assembled on the power supplier 200 in a rotation manner, such that the power pins 210 respectively contact the conductive elastic pieces 120 to be powered on. Specifically, as illustrated in FIG. 2A, the power supplier 200 includes an upper case 220, a lower case 230 and a second position-limiting member 240. The upper case 220 is assembled on the lower case 230 and has an assembly area 222, a circular assembly chute 224 and a plurality of positioning slots 226. The positioning slots 226 are disposed on the circular assembly chute 224 and connected to each other. The power pins 210 are assembled on the upper case 220 and located together with the second position-limiting member 240 within the assembly area 222. In this case, the second position-limiting member 240 is, for example, a bump, but the invention is not limited thereto. In addition, the power supplier 200 further includes a release pressing portion 250 disposed on the upper case 220.

Figure 5A:
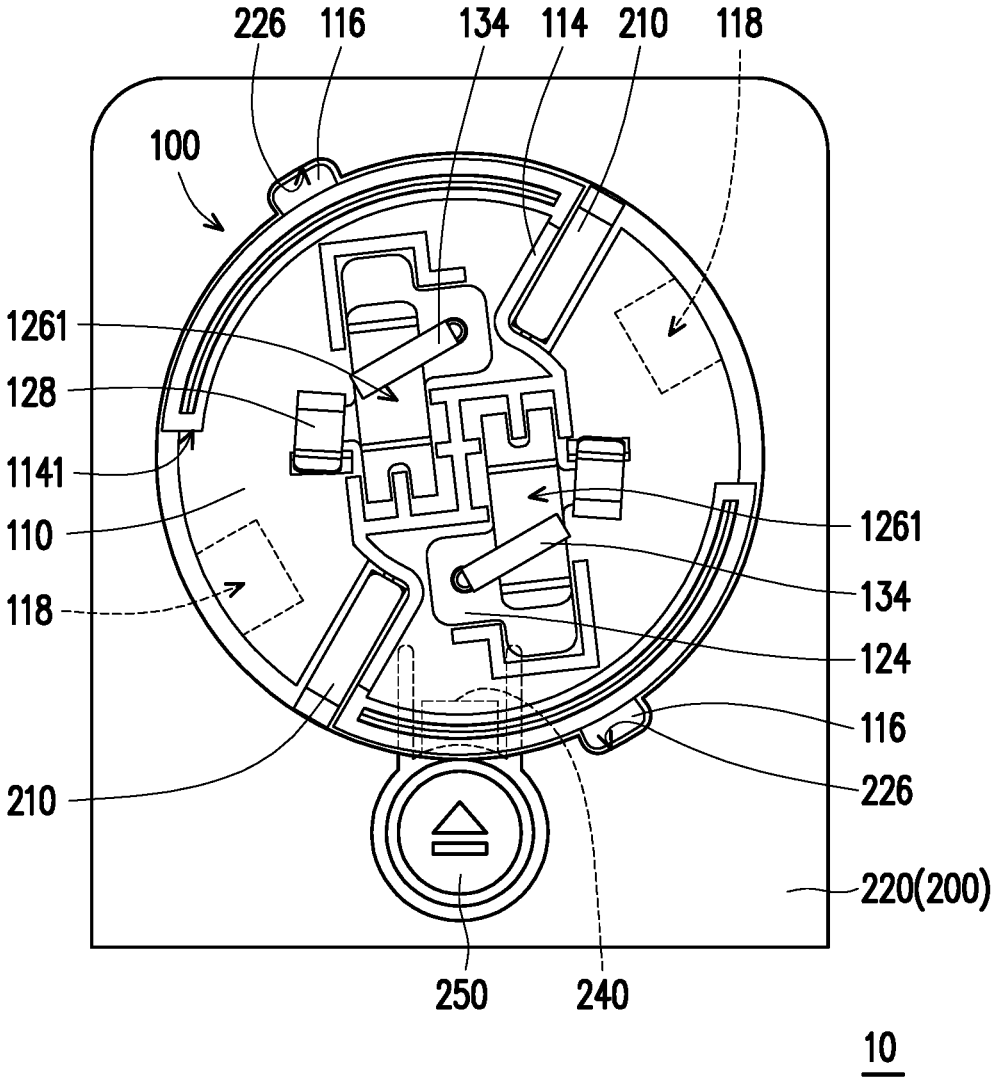
FIG. 5A to FIG. 5B are schematic top perspective diagrams illustrating an assembly process of the plug structure and the power supplier depicted in FIG. 1.
Figure 5B:
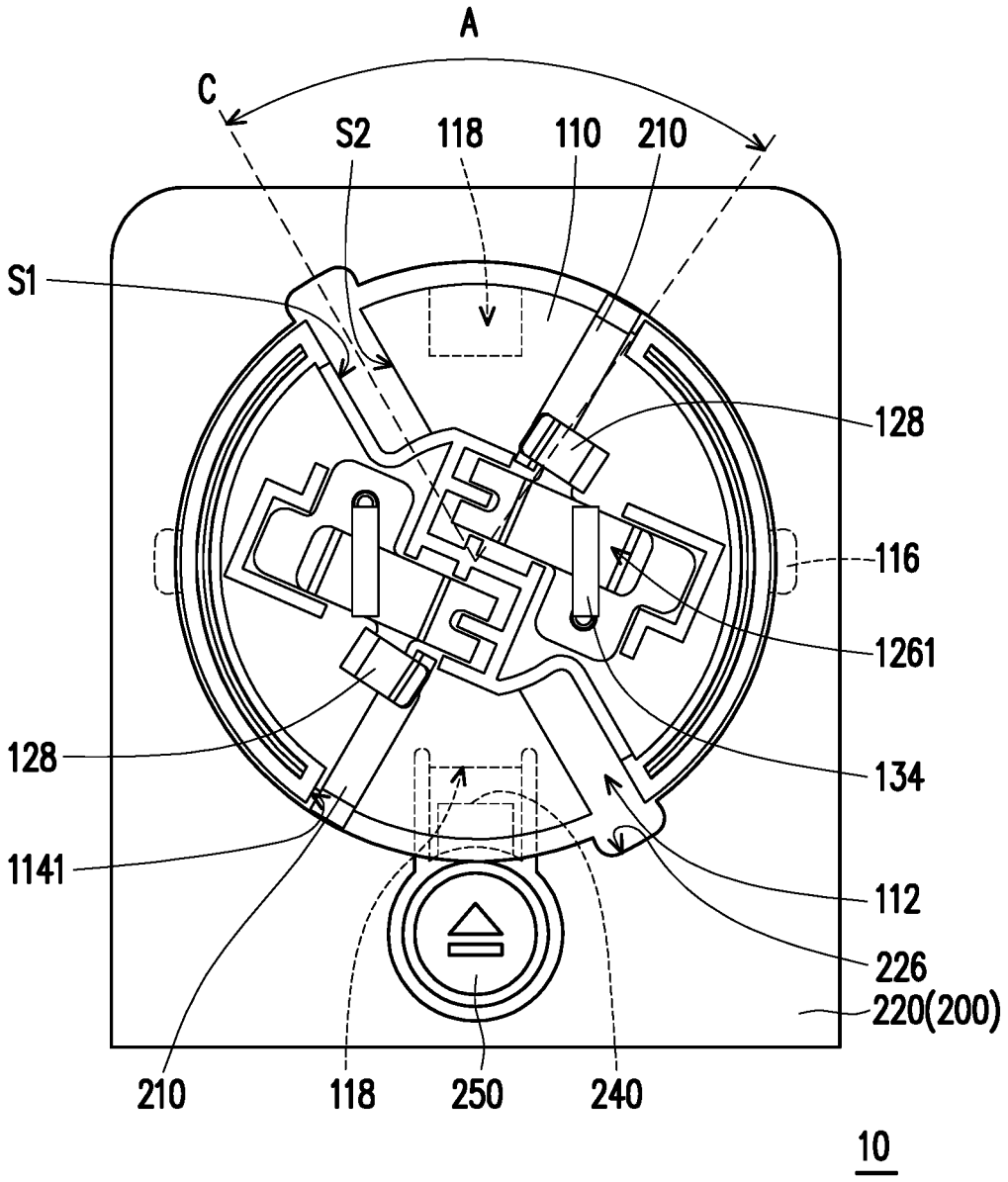

An assembly process and a detach process of the plug structure 100 and the power supplier 200 will be further described below. FIG. 5A to FIG. 5B are schematic top perspective diagrams illustrating an assembly process of the plug structure and the power supplier depicted in FIG. 1.

Referring to FIG. 2A and FIG. 5A, the assembly process of the power device of the present embodiment includes the following steps. First, the protrusion portions 116 of the pin base 110 of the assembled plug structure 100 are correspondingly assembled to the positioning slots 226 of the upper case 220 of the power supplier 200. In this circumstance, the power pins 210 of the power supplier 200 are respectively located in the accommodating slots 112 of the pin base 110.

Then, referring to FIG. 2A, FIG. 5A and FIG. 5B, the plug structure 100 is rotated counterclockwise relative to the power supplier 200 by the rotation angle A (i.e., not more than 60±10 degrees), wherein the protrusion portions 116 of the plug structure 100 respectively slide from positions of the corresponding positioning slots 226 into the circular assembly chute 224 (which limits the displacement of the plug structure 100 in the Z direction), such that one of the first position-limiting members 118 of the pin base 110 interferes and is locked with the second position-limiting member 240 of the power supplier 200 (which limits the displacement of the plug structure 100 in the X direction and the Y direction). In this circumstance, the power pins 210 of the power supplier 200 directly contact the power holding portions 128 of the conductive elastic pieces 120, wherein the power holding portions 128 hold the power pins 210, thereby conducting the plug structure 100 with the power supplier 200. Up to this step, the plug structure 100 is assembled to the power supplier 200, thereby completing the assembly of the power device 10.

It has to be mentioned that in the present embodiment, the first position-limiting members 118 of the pin base 110 are illustrated as the recesses as an example, and the second position-limiting member 240 of the power supplier 200 is illustrated as the bump as an example. However, in other embodiments which are not shown, the first position-limiting members may also be bumps, and the second position-limiting member of the power supplier may also be a recess, which falls within the scope to be protected by the invention.

Lastly, referring again to FIG. 1, FIG. 2A, FIG. 5A and FIG. 5B, when the plug structure 100 is to be replaced or repaired, the locking between the second position-limiting member 240 and the first position-limiting members 118 is released by pressing the release pressing portion 250 on the power supplier 200 (which releases the limitation of the displacement of the plug structure 100 in the X direction and the Y direction). The plug structure 100 is rotated clockwise relative to the power supplier 200 by the rotation angle A, such that the protrusion portions 116 of the plug structure 100 slide from the circular assembly chute 224 into the positions of the corresponding positioning slots 226 (which releases the limitation of the displacement of the plug structure 100 in the Z direction), thereby detaching the plug structure 100 from the power supplier 200.

In view of the foregoing, in the design of the plug structure of the invention, each of the conductive elastic pieces has the sharing area, the pin set is replaceably assembled on the pin base, the pins of the pin set are respectively disposed corresponding to the conductive elastic pieces and electrically coupled to the sharing area of each of the conductive elastic pieces. In this way, the pin sets complying with various standards can share the conductive elastic pieces, which can effectively reduce production cost. In addition, the plug structure of the invention is assembled into the power supplier in the rotation manner, wherein the safety standard distances of the plug structure are designed in the horizontal directions. In this way, the plug structure can be provided with features for miniaturization and thus, the power device of the invention can have favorable appearance aesthetics.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A plug structure, comprising:

a pin base;

a plurality of conductive elastic pieces, separately assembled on the pin base, wherein each of the plurality of conductive elastic pieces has a sharing area; and a pin set, replaceably assembled on the pin base and comprising a plurality of pins, wherein the plurality of pins are respectively disposed corresponding to the plurality of conductive elastic pieces and directly connected to the sharing area of each of the plurality of conductive elastic pieces, wherein each of the plurality of conductive elastic pieces further comprises a body portion, a fixing portion and a free portion bent relative to the body portion, the free portion is located on the body portion and has the sharing area, and each of the plurality of conductive elastic pieces is fixed on the pin base through the fixing portion.

2. The plug structure according to claim 1, wherein the pin base has a top surface, a peripheral surface surrounding the top surface, two accommodating slots and a partition, an end of each of the two accommodating slots is connected to the peripheral surface, the two accommodating slots are disposed in a penetrating axis of the pin base, the partition is disposed on the top surface, protrudes from a side of each of the two accommodating slots and protrudes from a part of the peripheral surface, and the partition divides the top surface into a plurality of symmetric areas.

3. The plug structure according to claim 2, wherein the pin base has a rotation angle, the partition has a plurality of blocking portions, and the rotation angle is between the penetrating axis and each of the plurality of blocking portions of the partition.

4. The plug structure according to claim 2, wherein the pin set comprises a cover, the cover has at least one engagement slot, and the at least one engagement slot is engaged on the partition, thereby assembling the pin set on the pin base.

5. The plug structure according to claim 4, wherein the cover covers the pin base and the plurality of conductive elastic pieces and has a plurality of openings, and the plurality of pins respectively pass through the plurality of openings to contact the plurality of conductive elastic pieces.

6. The plug structure according to claim 2, wherein the plurality of conductive elastic pieces are symmetrically disposed on the pin base, each of the plurality of conductive elastic pieces comprises a power holding portion, a first horizontal straight-line distance from a side of each of the two accommodating slots to the power holding portion nearby is at least 5.3 mm, and a second horizontal straight-line distance from the power holding portion to an edge of the pin base is at least 6.5 mm.

7. The plug structure according to claim 2, wherein a first vertical height of a first side of each of the two accommodating slots is greater than a second vertical height of a second side of each of the two accommodating slots, and the second vertical height is at least 1.7 mm.

8. The plug structure according to claim 1, wherein the pin set complies with one of plug standards required by the United States, the United Kingdom, the European Union (EU), Australia, Japan, China, Korea, India, Brazil, Argentina, and Republic of Namibia.

9. A power device, comprising:

a plug structure, comprising:

a pin base;

a plurality of conductive elastic piece, separately assembled on the pin base, wherein each of the plurality of conductive elastic pieces has a sharing area; and a pin set, replaceably assembled on the pin base and comprising a plurality of pins, wherein the plurality of pins respectively disposed corresponding to the plurality of conductive elastic pieces and directly connected to the sharing area; and a power supplier, comprising a plurality of power pins, wherein the plug structure is detachably assembled on the power supplier in a rotation manner, such that the plurality of power pins respectively contact the plurality of conductive elastic pieces to be powered on, wherein each of the plurality of conductive elastic pieces further comprises a body portion, a fixing portion and a free portion bent relative to the body portion, the free portion is located on the body portion and has the sharing area, and each of the plurality of conductive elastic pieces is fixed on the pin base through the fixing portion.

10. The power device according to claim 9, wherein the pin base has a top surface, a peripheral surface surrounding the top surface, two accommodating slots and a partition, an end of each of two the accommodating slots is connected to the peripheral surface, the two accommodating slots are disposed in a penetrating axis of the pin base, the partition is disposed on the top surface, protrudes from a side of each of the two accommodating slots and protrudes from a part of the peripheral surface, and the partition divides the top surface into a plurality of symmetric areas.

11. The power device according to claim 10, wherein the pin base has a rotation angle, the partition has a plurality of blocking portions, and the rotation angle is between the penetrating axis and each of the plurality of blocking portions of the partition.

12. The power device according to claim 10, wherein the pin set comprises a cover, the cover has at least one engagement slot, and the at least one engagement slot is engaged on the partition, thereby assembling the pin set on the pin base.

13. The power device according to claim 12, wherein the cover covers the pin base and the plurality of conductive elastic pieces and has a plurality of openings, and the plurality of pins respectively pass through the plurality of openings to contact the plurality of conductive elastic pieces.

14. The power device according to claim 10, wherein the plurality of conductive elastic pieces are symmetrically disposed on the pin base, each of the plurality of conductive elastic pieces comprises a power holding portion, a first horizontal straight-line distance from a side of each of the two accommodating slots to the power holding portion nearby is at least 5.3 mm, and a second horizontal straight-line distance from the power holding portion to an edge of the pin base is at least 6.5 mm.

15. The power device according to claim 10, wherein a first vertical height of a first side of each of the two accommodating slots is greater than a second vertical height of a second side of each of the two accommodating slots, and the second vertical height is at least 1.7 mm.

16. The power device according to claim 9, wherein the pin set complies with one of plug standards required by the United States, the United Kingdom, the European Union (EU), Australia, Japan, China, Korea, India, Brazil, Argentina, and Republic of Namibia.

17. The power device according to claim 9, wherein the pin base comprises two protrusion portions and two first position-limiting members, the power supplier comprises an upper case, a lower case and a second position-limiting member, the upper case is assembled on the lower case and has an assembly area, a circular assembly chute and a plurality of positioning slots, the plurality of positioning slots are disposed on the circular assembly chute, the plurality of power pins are assembled on the upper case and located together with the second position-limiting member within the assembly area, the two protrusion portions of the pin base respectively slide from positions of the corresponding positioning slots into the circular assembly chute and are rotated by an angle, such that one of the two first position-limiting members interferes and is locked with the second position-limiting member, thereby conducting the plug structure with the power supplier.

18. The power device according to claim 17, wherein the power supplier further comprises a release pressing portion disposed on the upper case, and the plug structure is detached from the power supplier by pressing the release pressing portion.

19. A plug structure, comprising:

a pin base;

a plurality of conductive elastic pieces, separately assembled on the pin base, wherein each of the plurality of conductive elastic pieces has a sharing area; and a pin set, replaceably assembled on the pin base and comprising a plurality of pins, wherein the plurality of pins are respectively disposed corresponding to the plurality of conductive elastic pieces and directly connected to the sharing area of each of the plurality of conductive elastic pieces, wherein the pin base has a top surface, a peripheral surface surrounding the top surface, two accommodating slots and a partition, an end of each of the two accommodating slots is connected to the peripheral surface, the two accommodating slots are disposed in a penetrating axis of the pin base, the partition is disposed on the top surface, protrudes from a side of each of the two accommodating slots and protrudes from a part of the peripheral surface, and the partition divides the top surface into a plurality of symmetric areas.

* * * * *